US006522756B1

(12) United States Patent
Maisano et al.

(10) Patent No.: US 6,522,756 B1
(45) Date of Patent: Feb. 18, 2003

(54) METHOD FOR SHAPING THE SPATIAL RECEPTION AMPLIFICATION CHARACTERISTIC OF A CONVERTER ARRANGEMENT AND CONVERTER ARRANGEMENT

(75) Inventors: Joseph Maisano, Neuchâtel (CH); Werner Hottinger, Neuchâtel (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/267,742

(22) Filed: Mar. 15, 1999

(30) Foreign Application Priority Data

Mar. 5, 1999 (EP) ..... 99104443

(51) Int. Cl.[7] ..... H04R 3/00

(52) U.S. Cl. ..... 381/92; 381/123; 381/164; 381/91

(58) Field of Search ..... 381/91, 122, 92, 381/56, 104, 107, 120, 123

(56) References Cited

U.S. PATENT DOCUMENTS

| | | | | |
|---|---|---|---|---|
| 4,536,887 A | | 8/1985 | Kaneda et al. | |
| 4,751,738 A | | 6/1988 | Widrow et al. | |
| 5,058,171 A | * | 10/1991 | Wurzer | 381/92 |
| 5,539,859 A | | 7/1996 | Robbe et al. | |
| 5,581,620 A | | 12/1996 | Brandstein et al. | |
| 5,684,882 A | | 11/1997 | Mahieux et al. | |

FOREIGN PATENT DOCUMENTS

| | | |
|---|---|---|
| EP | 0 289 401 | 11/1988 |
| EP | 557 166 A1 | 8/1993 |
| EP | 652 686 A1 | 5/1995 |
| EP | 0 652 686 A1 | 5/1995 |
| EP | 0 802 699 A2 | 10/1997 |
| EP | 0 820 210 A2 | 1/1998 |
| GB | 2 212 619 A | 7/1989 |
| JP | 05079899 A | 3/1993 |

OTHER PUBLICATIONS

XP–002053435, Evaluation of an adaptive beamforming method for hearing aids.

XP–002050302, Noise Suppression signal Proessing Using 2–Point Received Signals.

* cited by examiner

*Primary Examiner*—Minsun Oh Harvey
(74) *Attorney, Agent, or Firm*—Pearne & Gordon LLP

(57) ABSTRACT

So as to shape the spatial amplification characteristic of an acoustical to electrical converter arrangement at least two sub-arrangements (I, II) of converters are provided, generating different spatial amplification characteristics. Frequency domain converted signals ($\tilde{S}_1$) which are proportional to the output signals of the sub-arrangement are compared in a unit (39) on respective spectral frequencies ($f_s$) and there is generated at the output of the comparing unit (39) a binary spectral comparison result signal ($A_{39}$). Signals ($\tilde{S}_2$) which are as well proportional to the output signals of the sub-arrangements (I, II) are fed to a switching unit (41). For each spectral frequency ($f_B$) the control signal from unit 39, as a binary spectral signal, controls the spectral amplitude of which of the two input signals ($\tilde{S}_2$) is passed to the output ($A_{41}$) of the switching unit and of the arrangement.

22 Claims, 8 Drawing Sheets

METHOD FOR SHAPING THE SPATIAL RECEPTION AMPLIFICATION CHARACTERISTIC OF A CONVERTER ARRANGEMENT AND CONVERTER ARRANGEMENT

The present invention is generically directed on reception "lobe" shaping of a converter arrangement, which converts an acoustical input signal into an electrical output signal. Such a reception "lobe" is in fact a spatial characteristic of signal amplification, which defines, for a specific reception arrangement considered, the amplification or gain between input signal and output signal in dependency of spatial direction with which the acoustical input signal impinges on the reception arrangement. We refer to such spatial reception characteristics throughout the present description by the expression "spatial amplification characteristic".

Such spatial amplification characteristic may be characteristically different, depending on the technique used for its shaping, for instance dependent from the fact whether the reception arrangement considered is of first, second or higher order.

As is well known from transfer characteristic behaviour in general, a first order arrangement has a frequency versus amplitude characteristic characterised by 20 dB per frequency decade slopes. Accordingly, a second order reception arrangement has 40 dB amplitude slopes per frequency decade and higher order reception arrangements of the order n, 20 n dB amplitude per frequency decade slopes. We use this criterion for defining respective orders of acoustical/electrical transfer characteristics.

The order of a reception arrangement may also be recognised by the shape of its spatial amplification characteristic.

Figure 1:
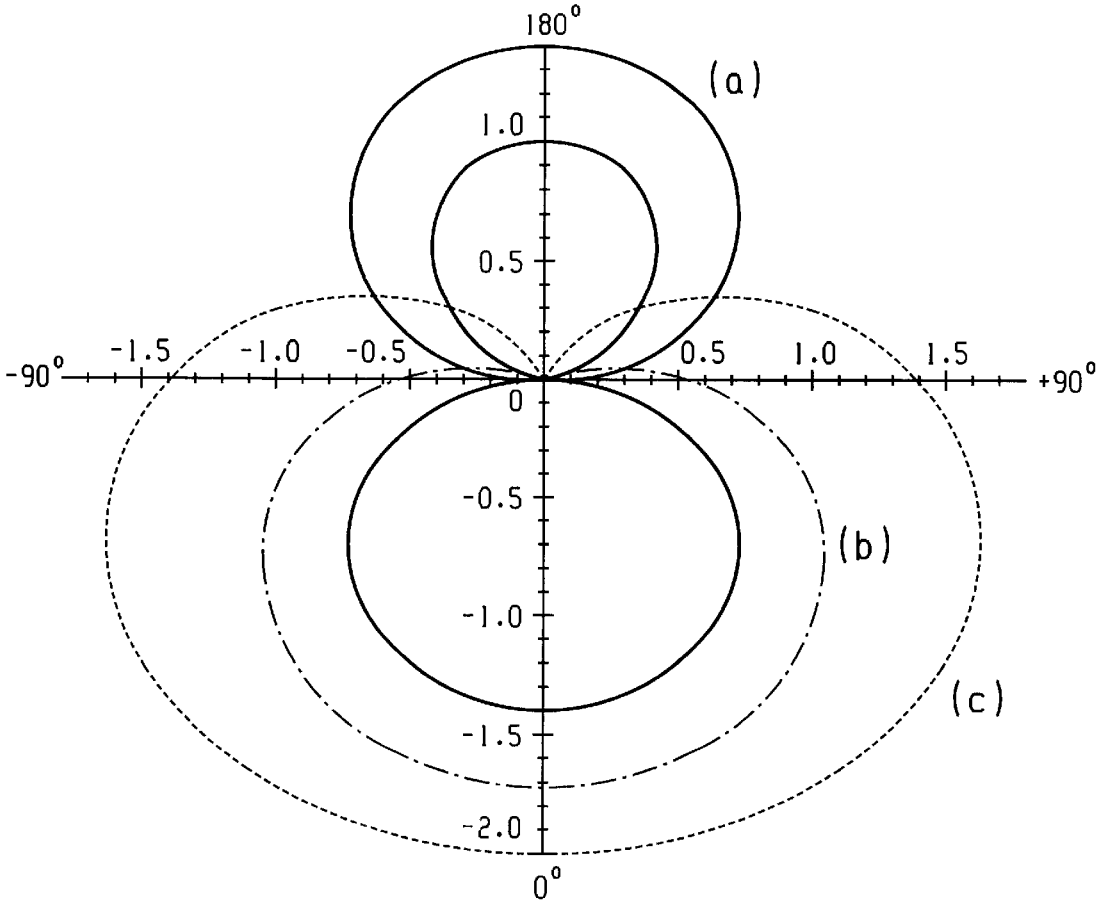

In FIG. 1, there are shown three spatial amplification characteristics in plane representation of a first-order acoustical/electrical converting arrangement. The spatial amplification characteristic (a) is said to be of "bi-directional"-type. It has equal lobes in forwards and backwards direction with respective amplification maxima on one spatial axis, according to FIG. 1 the 0°/180° axis and has amplification zeros on the second axis according to the +90/−90° axis of FIG. 1.

The second characteristic according to (b) shows an increased lobe in one direction as in the 0° direction according to FIG. 1, thereby a reduced lobe characteristic in the opposite direction according to 180° of FIG. 1. This characteristic is of "hyper-cardoid"-type. The lobe of the spatial amplification characteristic may further be increased in one direction as in the 0° direction of FIG. 1, up to characteristic (c), where the lobe in the opposite direction, i.e. the 180° direction of FIG. 1 disappears. The characteristic according to (c) is named "cardoid"-type characteristic. Thus, "bi-directional" and "cardoid"-types are extreme types, the "hyper-cardoid"-type is in between the extremes.

Figure 2:
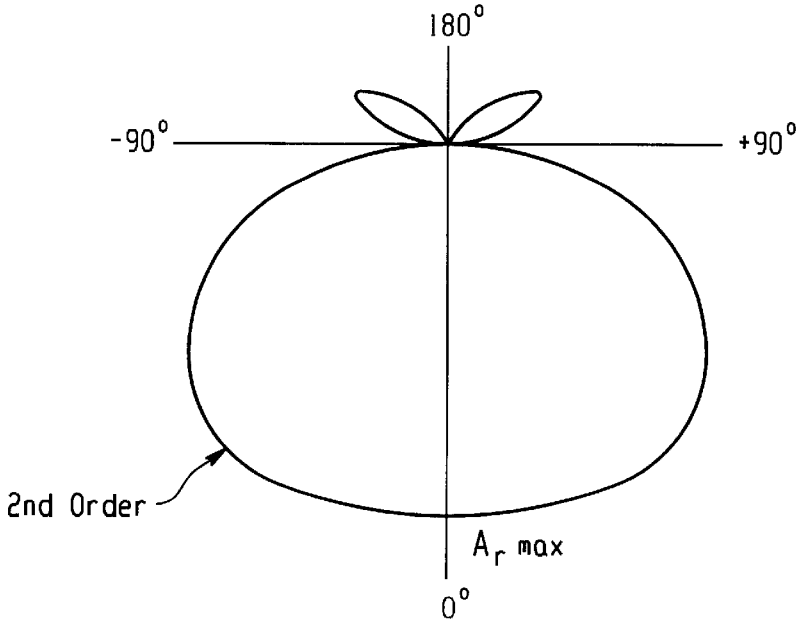

At second and higher order reception arrangements the spatial amplification characteristics become more complicated having an increasing number of side-lobes. FIG. 2 shows one example of a second order amplification characteristic of cardoid-type.

In the EP 0 802 699 of the same applicant as the present application and which accords to the U.S. application Ser. No. 09/146 784 and to the PCT/IB98/01069, it is described in detail how a reception arrangement for acoustical/electrical signal conversion may be realised, with a desired spatial amplification characteristic. Thereby, two spaced apart acoustical/electrical converters, microphones, are of multi- or omni-directional spatial amplification characteristic. They both convert acoustical signals irrespective of their impinging direction and thus substantially unweighted with respect to impinging direction into their respective electrical output signals. To realise from such two-microphone arrangement a desired spatial amplification characteristic the output signal of one of the two microphones is time-delayed —τ—, the time-delayed output signal is superimposed with the undelayed output signal of the second microphone.

It is further described, with an eye on FIG. 1 of the present application, how the time-delay τ is to be selected for realising bi-directional, hyper-cardoid or cardoid-type spatial amplification characteristics: For the time-delay τ=0 the characteristic becomes bi-directional (a), by increasing τ the characteristic becomes hyper-cardoid, and finally becomes cardoid (c) if τ is selected as the quotient of microphone spacing —p— to speed of sound, c. This technique, which has been known for long is referred to as "delay and superimpose" technique.

In this literature, which is to be considered as an integral part of the present invention by reference, it is further described how spatial amplification characteristic shaping may be improved, following the concept of electronically i.e. "virtually" controlling the effective spacing of the converters without influencing their physical "real" spacing.

First-order reception arrangements for acoustical input signals and especially when realised with a pair of omni-directional converters, as of microphones and as described in detail in the above mentioned literature, have several advantages over higher order reception arrangements. These advantages are especially:

- simple electronic structure and small constructional volume, which is especially important for miniaturised applications as e.g. for hearing aid applications,
- low cost,
- low sensitivity to mutual matching of the converters used, as of the microphones,
- small roll-off, namely of 20 dB per frequency decade.

Nevertheless, such a reception arrangement, as mentioned construed of two multi- or omni-directional converters has disadvantages, namely:

- The maximum theoretical directivity index DI is limited to 6 dB, in practise one achieves only 4 dB to 5 dB. With respect to the definition of the directivity index DI please refer to speech communication 20 (1996), 229–240, "Microphone array systems for hand-free telecommunications", Garry W. Elko.

It is an object of the present invention to quit with the disadvantages mentioned above, thereby keeping the advantages. Although the present invention departs from advantages and disadvantages of first order reception arrangements directed on acoustical signal treatment, it must be emphasised that once the inventive concept has been recognised, principally it may be applied to other types of reception arrangements, as to higher order reception arrangements.

To resolve the above mentioned object the present invention proposes a method for shaping the spatial amplification characteristic of an arrangement which converts an acoustical input signal to an electrical output signal and wherein, as was mentioned above, the spatial amplification characteristic defines for the amplification with which the input signal impinging on the arrangement is amplified, as a function of its spatial impinging angle, to result in the electrical output signal.

The inventive method thereby further comprises the following steps:

There are provided at least two sub-arrangements with at least one converter which sub-arrangements each convert an acoustical input signal to an electrical output signal, but which sub-arrangements have different spatial amplification characteristics.

There are generated at least two first signals which are proportional to the output signals of the sub-arrangements, in frequency domain and with a number of spectral frequencies.

There are further generated at least two second signals which are proportional to the output signals of the sub-arrangements, in frequency domain, and with said number of said spectral frequencies. Thus, the first and second signals may, but need not be equal.

The magnitudes of spectral amplitudes of the at least two first signals at equals of said spectral frequencies are compared, there results for each spectral frequency mentioned one comparison result. By these "spectral" comparison results one controls, which of the spectral amplitudes of the second signals at respective ones of the spectral frequencies mentioned is passed to the output of the arrangement.

Thereby, it principally becomes possible to combine the advantages of either of the at least two specific spatial amplification characteristic of the sub-arrangements so that the combination exploits that spatial amplification characteristic which is more advantageous in a predetermined spectral angular range, thereby quitting its disadvantages by selecting the second amplification characteristic to be active in a further spectral angular range, there exploiting the advantages of the second characteristic.

In a most preferred mode comparison is performed to indicate as a result, which of the spectral magnitudes at a respective frequency is smaller than the other. Thereby and in a further preferred mode, the second signal spectral amplitude is passed which accords with the smaller magnitude of the magnitudes being compared.

In a further most preferred mode of realisation the at least two sub-arrangements of converters are realised with one common set of converters and the different amplification characteristics requested are realised by different electric treatments of the output signals of the converters. As in a most preferred form of realisation, the above mentioned "delay and superimpose"-technique is used, e.g. from two specific converters and with implying in parallel two or more than two different time delays—$\tau$—, two or more different amplification characteristics may be realised e.g. just with one pair of converters.

Further preferred modes of operation of the inventive method will become apparent from the following detailed description of examples of the present invention and are specified in the dependent method claims.

So as to resolve the above mentioned object there is further proposed a reception arrangement which comprises at least two converter sub-arrangements, which each converts an acoustical input signal to an electric output signal at the outputs of the sub-arrangements respectively.

There is further provided a comparing unit with at least two inputs and with an output. This comparing unit compares magnitudes of spectral amplitudes at spectral frequencies of a signal applied to one of its inputs with magnitudes of spectral complitudes at respective equal frequencies of a signal applied to the other of its inputs. Thereby the comparing unit generates a spectral comparison result signal at its output. The outputs of the at least two sub-arrangements are operationally connected to the at least two inputs of the comparing unit.

There is further provided a switching unit with at least two inputs, a control input and an output. The switching unit switches spectral amplitudes of a signal applied at one of its inputs to its output, controlled by a spectral—binary—signal at its control input. The signal at the control input frequency-specifically controls which one of the at least two inputs of the switching unit is the said one input to be passed. The output of the comparing unit is thereby operationally connected to the control input of the switching unit, the at least two inputs of the switching unit are operationally connected to the outputs of the at least two sub-arrangements.

Preferred embodiments of such inventive converter arrangement will become apparent to the skilled artisan when reading the following detailed description and are further defined in the dependent apparatus claims.

Thereby, the inventive apparatus and method are both most suited to be realised as shaping method implied in a hearing aid apparatus and as a hearing aid apparatus respectively.

Figure 3:
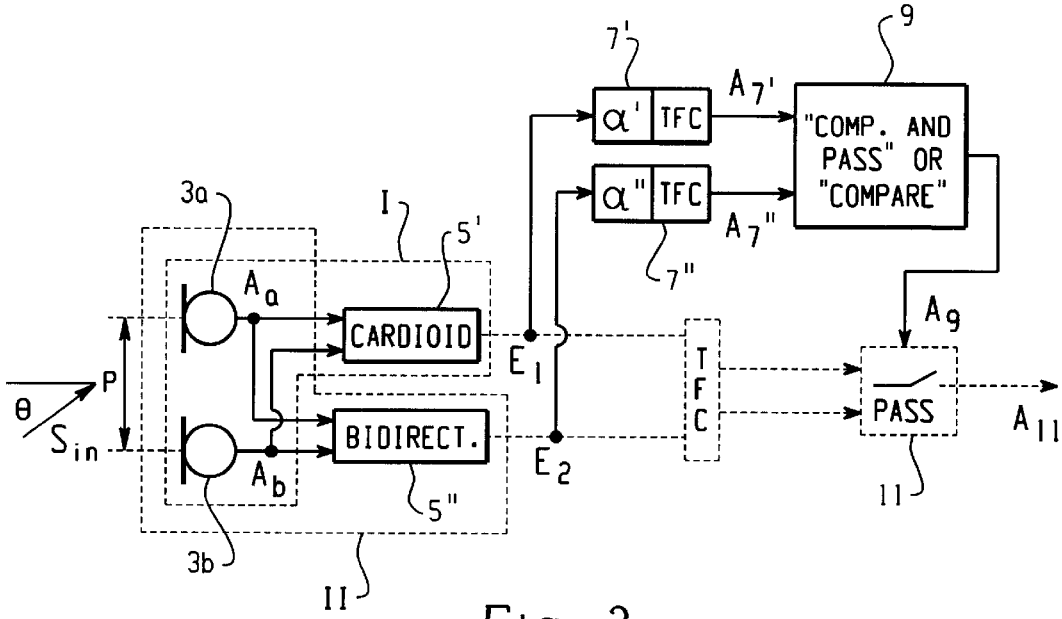
Figure 4:
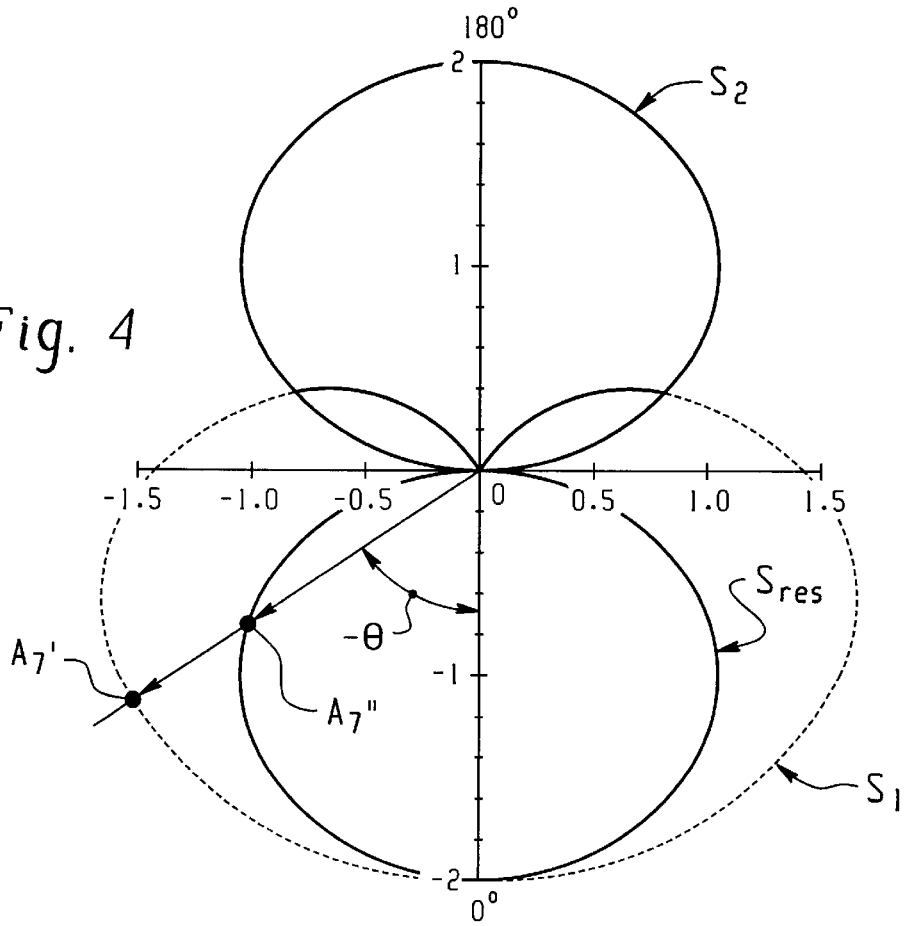
Figure 5:
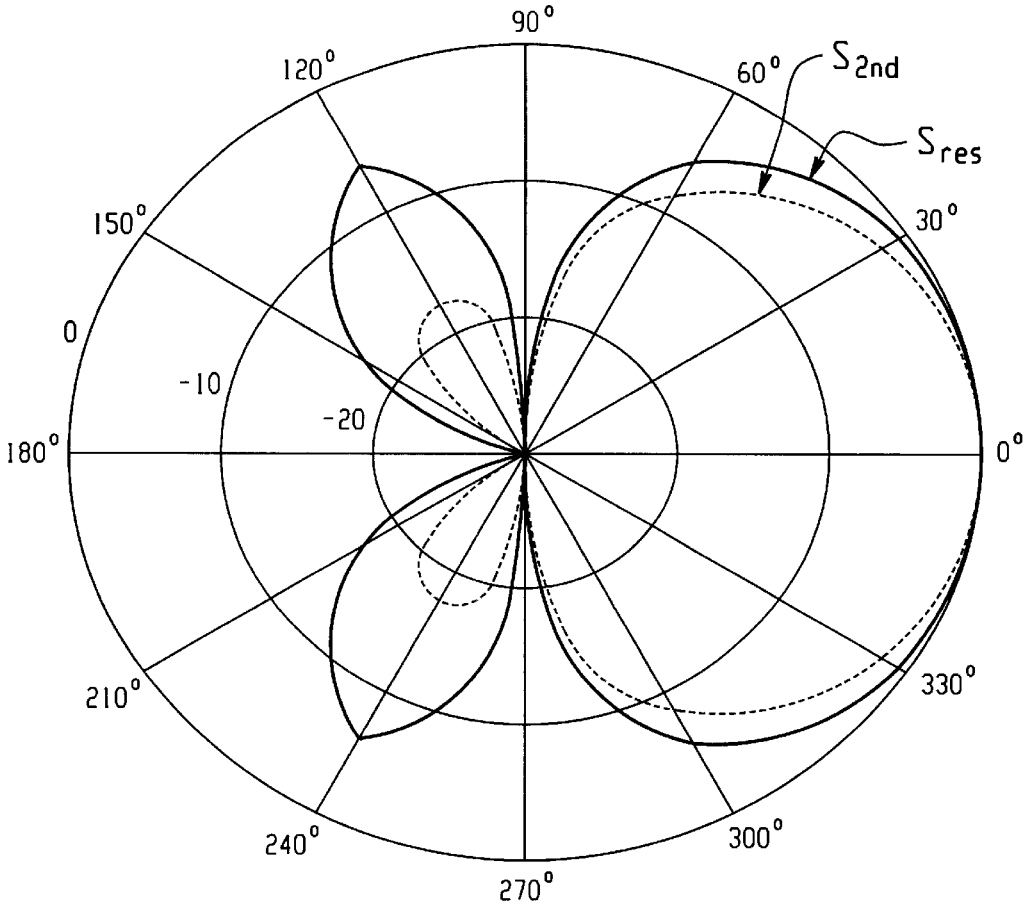
Figure 6:
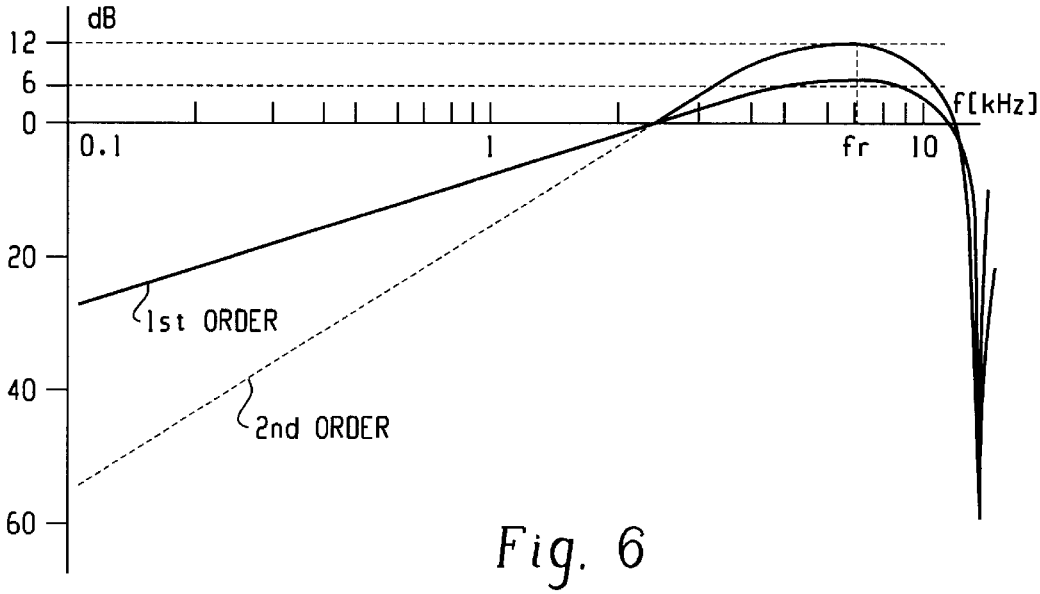
Figure 7:
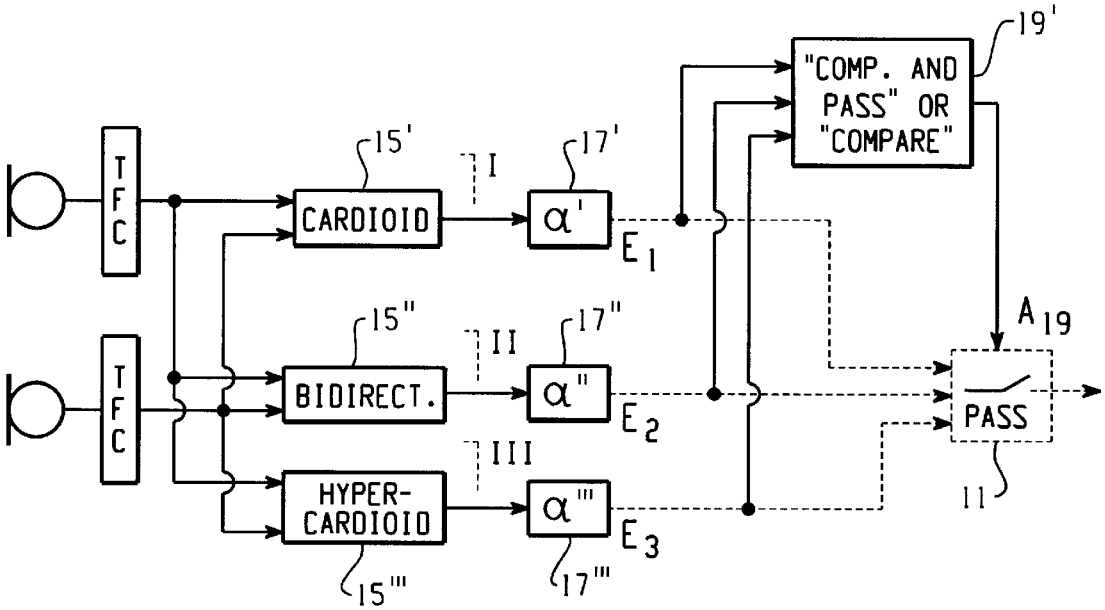
Figure 8:
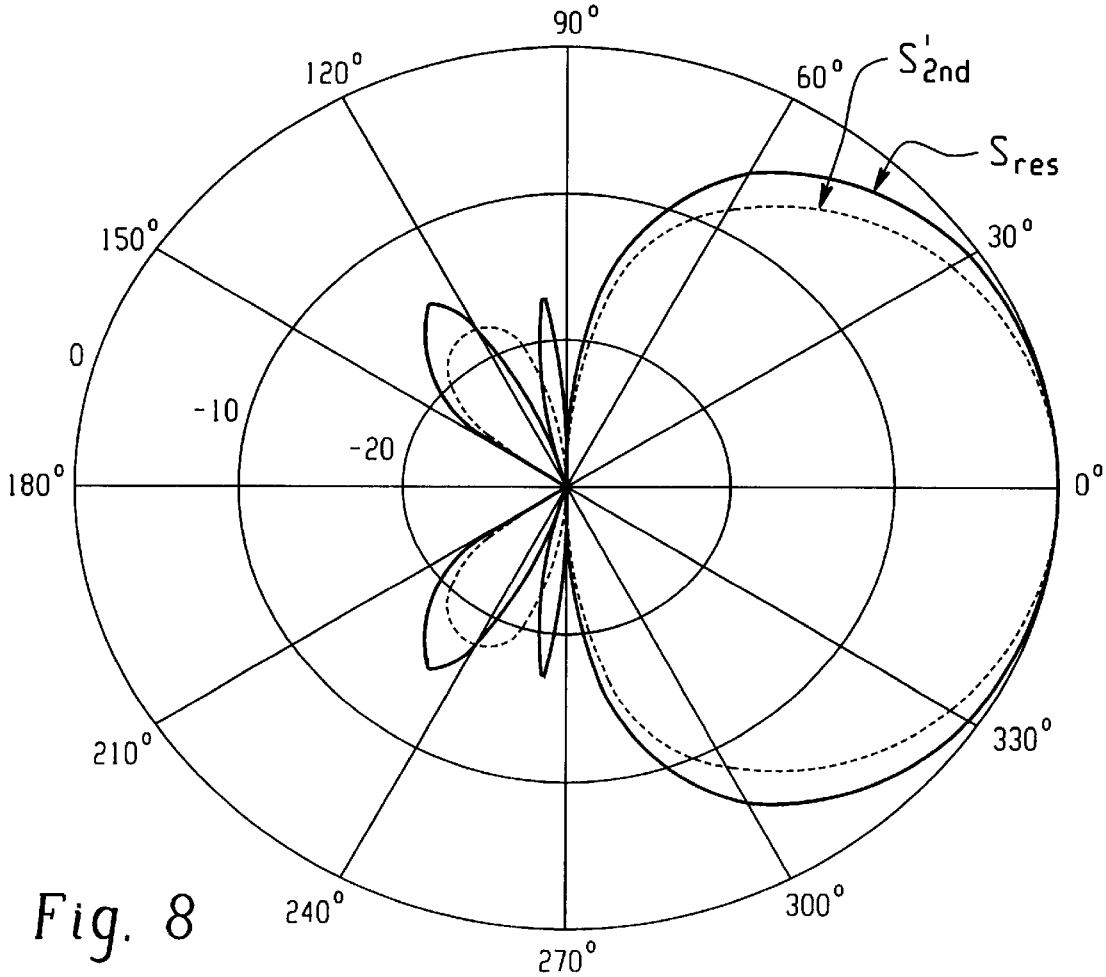
Figure 9:
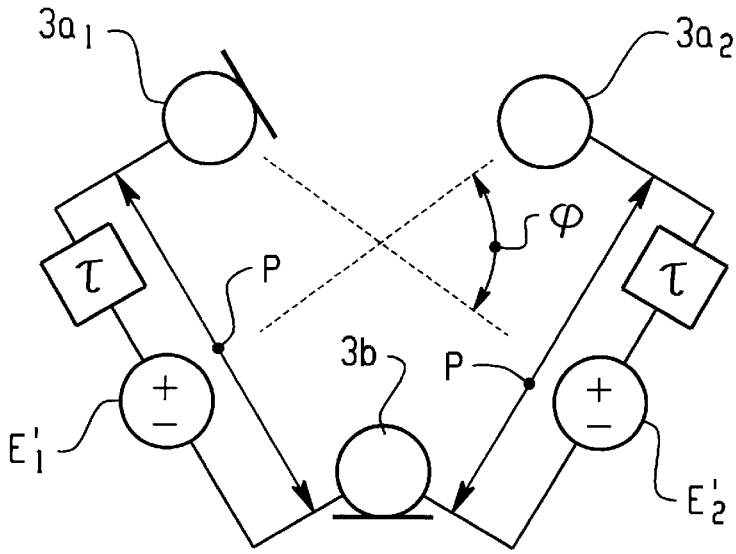
Figure 10:
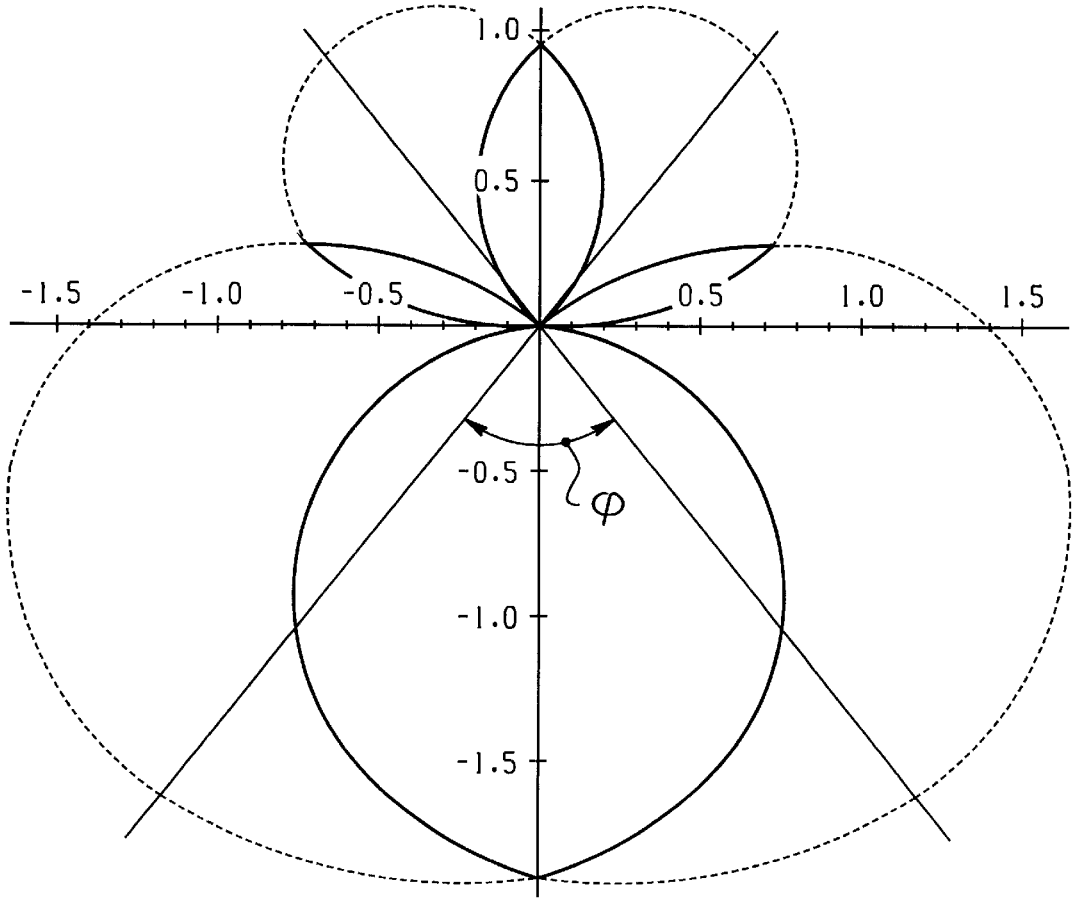
Figure 11:
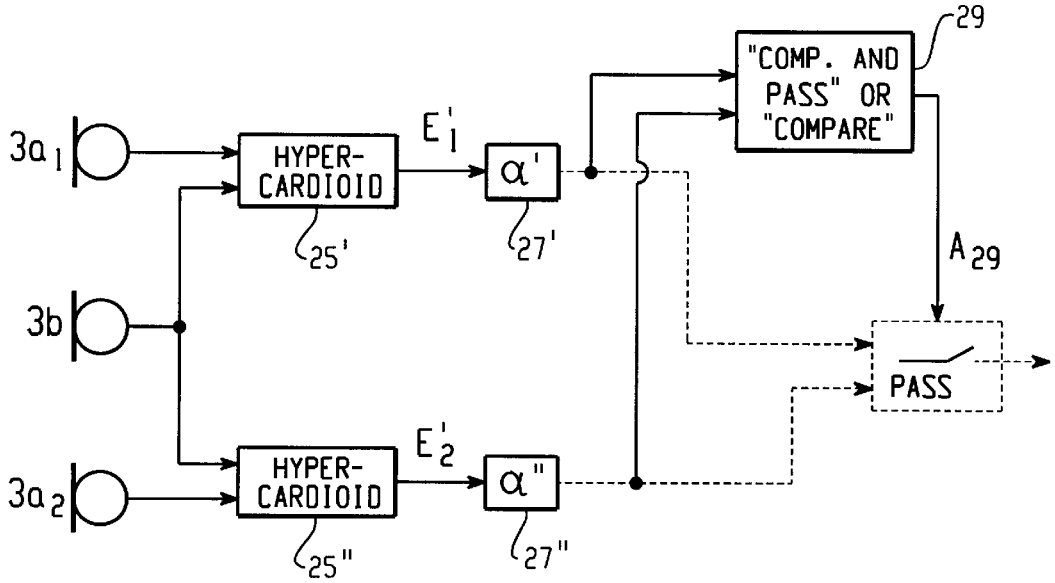
Figure 12:
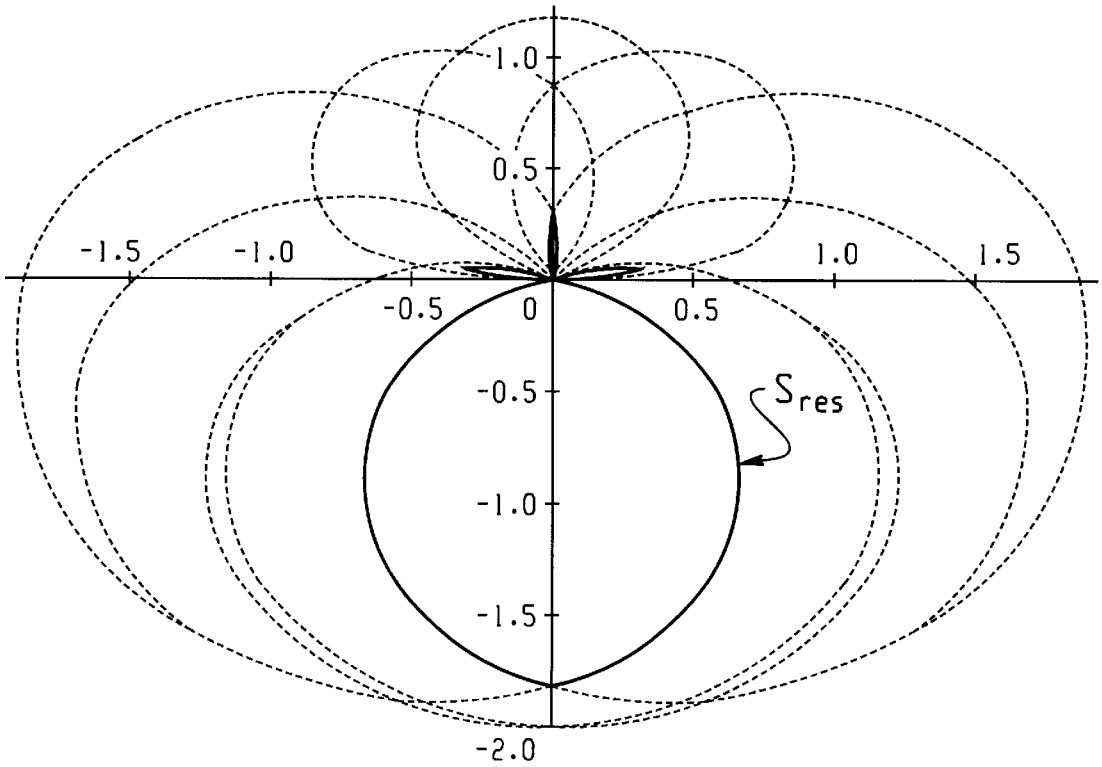
Figure 13:
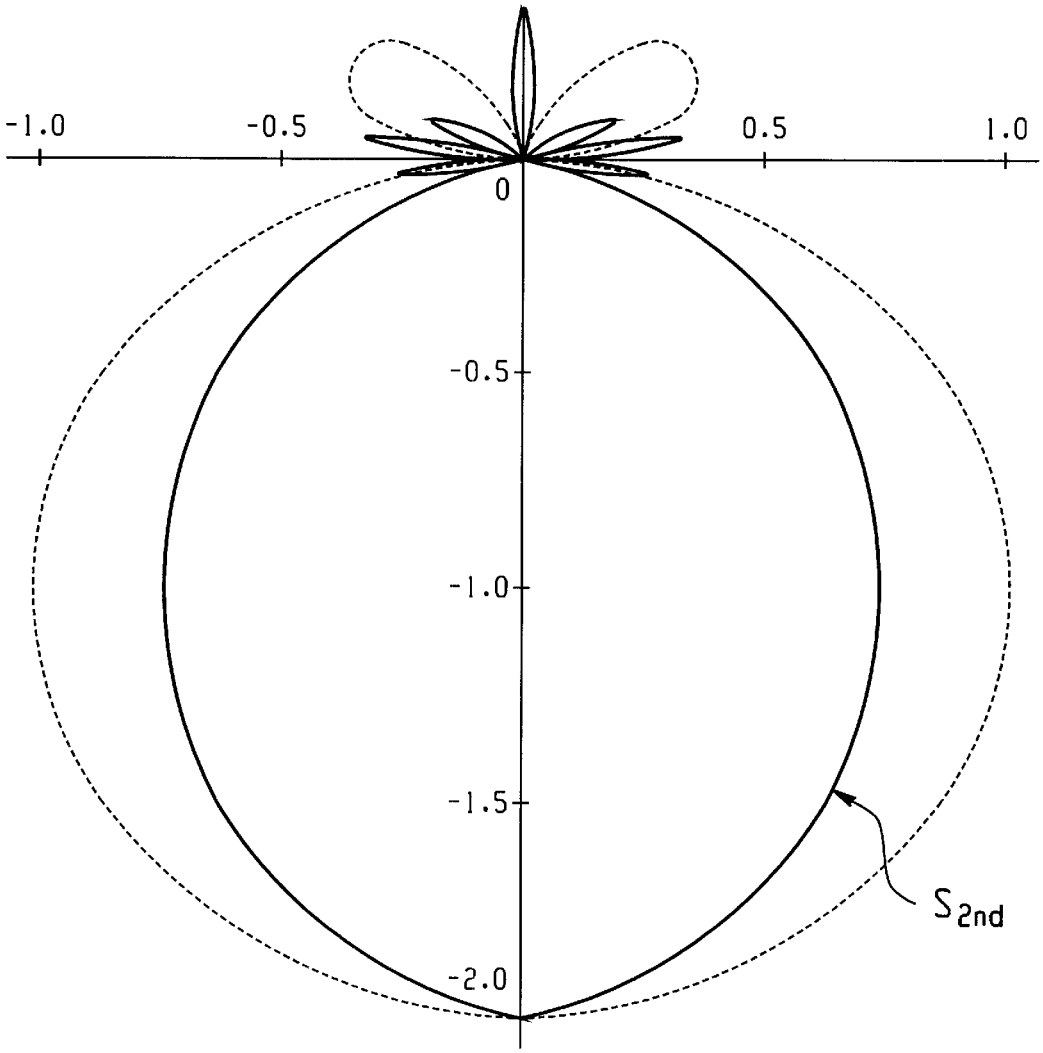
Figure 14:
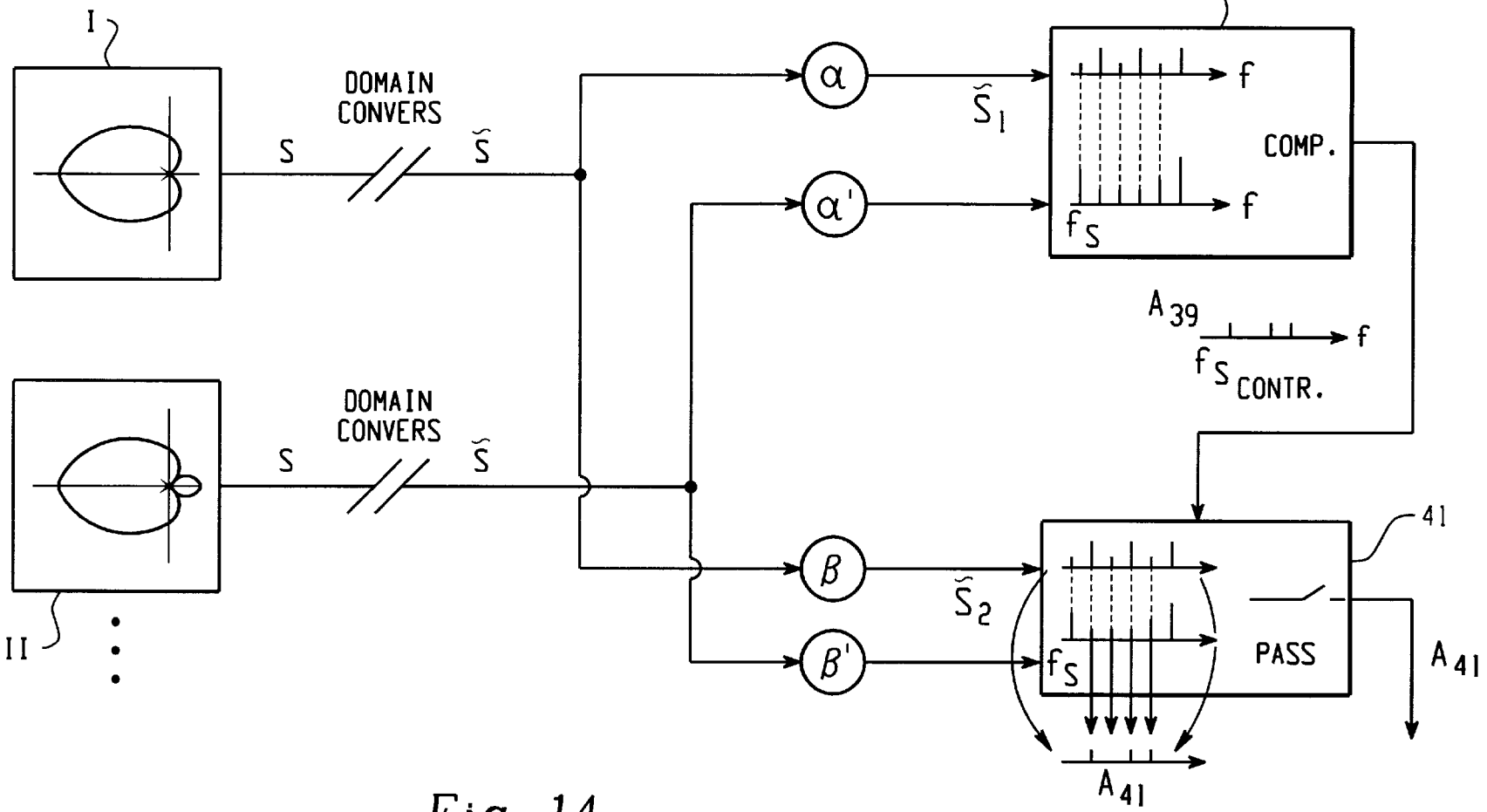

The invention will now be described by way of examples based on figures. The figures show:

FIG. 1 three different spatial amplification characteristics of a first-order converter arrangement, FIG. 2 an example of the spatial amplification characteristic of a second-order converter arrangement, FIG. 3 in form of a functional block/signal flow diagram a first preferred inventive converter arrangement operating according to the inventive method, FIG. 4 in a representation according to FIG. 1 on one hand the two spatial amplification characteristics of inventively used sub-arrangements as of FIG. 3 and the resulting spatial amplification characteristic of the overall arrangement as of FIG. 3, FIG. 5 for comparison purposes the spatial amplification characteristic according to FIG. 4 and the spatial amplification characteristic of a second order cardoid arrangement for comparison, FIG. 6 the frequency roll-off as measured at the arrangement according to FIG. 3 and that of a second order arrangement for comparison, FIG. 7 a further preferred embodiment of the inventive reception arrangement operating according to the inventive method, FIG. 8 the spatial amplification characteristic resulting from the arrangement of FIG. 7 and for comparison purposes, such characteristic of a second-order arrangement, FIG. 9 a further preferred layout of two inventively used sub-arrangements, FIG. 10 the resulting spatial amplification characteristic of the sub-arrangements of FIG. 9 applied to the arrangement e.g. as of FIG. 3, FIG. 11 principally the arrangement according to FIG. 3 fed by the two sub-arrangements as of FIG. 9, FIG. 12 the resulting spatial amplification characteristic of an inventive arrangement with five sub-arrangements, the output signals thereof being treated as was explained for two sub-arrangements with the help of FIG. 3, FIG. 13 for comparison purposes the respective spatial amplification characteristic of a second-order arrangement, and FIG. 14 a generic functional block/signal flow diagram of the inventive arrangement, operating according to the inventive method.

According to FIG. 3 the inventive converter arrangement in one preferred form of realisation comprises two signal inputs $E_1$ and $E_2$ to which the electric output signals of respective sub-arrangements I, II of converters are fed. In a most preferred form and as shown in FIG. 3 both converter sub-arrangements I, II commonly comprise one pair of converters $\mathbf{3}_a$ and $\mathbf{3}_b$ e.g. of multi- or omni-directional microphones for acoustical to electrical signal conversion.

Out of these commonly provided two converters 3*a* and 3*b* one sub-arrangement I with its specific spatial amplification characteristic is formed in a first signal processing unit 5', whereas from the same two converters $\mathbf{3}_a$ and $\mathbf{3}_b$ the second sub-arrangement II is formed by a further signal treatment unit 5". The output signals of the converters $\mathbf{3}_{a,b}$ are thus both fed to both signal treatment units 5', 5".

For instance and in a most preferred embodiment making use of the known "delay and superimpose"-technique as was mentioned above and as described in detail for instance in the above mentioned EP 0 802 699 with its US- and PCT-counterparts, unit 5' forms a cardoid-type spatial amplification characteristic in that one of the converter output signal $A_a$ or $A_b$ is time-delayed by a $\tau$-value according to converter spacing p divided by the speed of sound c and then the two signals, i.e. the time-delayed and the undelayed, are superimposed. There results a "cardoid"-type spatial amplification characteristic as of (c) of FIG. 1. By means of the second signal treatment unit 5" and again preferably making use of the said "delay and superimpose" technique, e.g. a "bi-direction"-type spatial amplification characteristic as of (a) of FIG. 1 is realised, thereby selecting time-delay $\tau=0$.

In FIG. 4 the spatial amplification characteristic $S_2$ of sub-arrangement II (bi-directional) and the spatial amplification characteristic $S_1$ of arrangement I (cardoid) are shown. When considering these two characteristics $S_1$, $S_2$ one most advantageous characteristic would e.g. be exploiting $S_2$, i.e. the bi-directional characteristics towards 0° direction and to dampen signals impinging from the semi-space comprising the 180° direction, as far as possible.

Thus, according to FIG. 4 a most advantageous spatial amplification characteristic would be that marked with $S_{res}$. So as to realise such a spatial amplification characteristic $S_{res}$ and as reveals comparison with FIG. 1, either the signal at input $E_2$ of FIG. 3, that is resulting from the "bi-direction" sub-arrangement II is amplified and/or the signal at $E_1$ according to the output signal of the "cardoid" sub-arrangement I is amplified so that in 0°-direction according to FIG. 4 both sub-arrangements do have equal amplifications.

For instance only the output signal of the "cardoid" sub-arrangement I is amplified (amplification<1), with respect to signal power, by a factor of 0.5. (Please note that FIG. 1 denotes amplitude amplification and not power amplification). Thus and according to FIG. 3 the output signal of the respective sub-arrangement I and II are fed to respective treatment units 7' and 7" where the input signals are respectively amplified by amplification factor $\alpha'$ and/or $\alpha''$ and are further time domain to frequency domain converted e.g. by respective TFC units, e.g. by FFT (faster-fourier-transform) units. As the output of the respective units 7' and 7" the respectively amplified spectral representations of the sub-arrangement output signals appear.

Turning back to FIG. 4 it becomes evident that for one signal impinging under a specific angle of $-\theta$ on the overall arrangement, as $S_{in}$ of FIG. 3, the one frequency component considered at the output of unit 7' and thus of the output signal $A'_7$ will be as denoted in FIG. 4 on the frequency-specific amplification characteristics $S_1$, the same frequency component at the output signal $A''_7$ of unit 7" will be on the characteristic $S_2$.

The two frequency domain output signals of the units 7', 7" are input to a selection unit 9, which is controlled to follow up a predetermined selection criterion with respect to the question which of the two input signals $A_7$, or $A_{7'}$, is to be passed to the output signal $A_9$ of the overall converter arrangement.

If unit 9 is controlled to pass the smaller-power signal of the two signals $A_7$, and $A_{7'}$, the output signal $A_9$, will have a spatial amplification characteristic $S_{rel}$ as desired in dependency of impinging angle $\theta$. Depending on further signal treatment, e.g. in a hearing aid device, $A_9$ is frequency domain to time domain reconverted just after unit 9 or after further signal treatment.

It has to be emphasised that time domain to frequency domain conversion may be performed anywhere between the converters 3*a*, 3*b* and the selection unit 9. If this conversion is done upstream the treatment units 5', 5" these units are realised as operating in frequency domain.

As is shown in dotted lines it might be advantageous to realise unit 9 merely as a comparing unit, which generates at its output a spectrum of comparison results. As such comparing unit 9 outputs a binary signal at each spectral frequency, dependent from the fact which of the two input signals $A'_7$, $A''_7$ has respectively larger magnitudes of spectral amplitudes, this signal is used as a switching control signal for a switching unit 11.

The output signals of the two sub-arrangements I, II are, converted to frequency domain and possibly (not shown) respectively amplified, fed to the switching unit 11. At each spectral frequency the control signal from comparing unit 9 selects which input is passed to the output $A_{11}$, namely that one which accords to the input signal to comparing unit 9 which has, at a spectral frequency considered preferably, the smaller magnitude of spectral amplitude.

If unit 9 is realised to itself select and pass the smaller magnitude spectral amplitudes acting as comparing and switching unit, then the amplification characteristic $S_{res}$ of FIG. 4 is realised.

The resulting spatial amplification characteristic $S_{res}$ is not a real second order characteristic, but is a bi-directional characteristic with suppressed lobe in backwards (180°) direction. Only two side-lobes remain as of a second order characteristic. The resulting spatial amplification characteristics $S_{res}$ leads to a directivity index DI of 6.7 dB with a roll-off of 20 dB per frequency decade, as it still results from first order sub-arrangements I, II.

This shaping technique is further linear with no distortion and uses very little processing power, thereby in fact remedying the above mentioned drawbacks, and maintaining the said advantages.

One can name arrangements with the resulting characteristic as of $S_{res}$ a "1½"-order arrangement as it has in fact frequency roll-off according to a first order converter arrangement and has a spatial amplification characteristic according to a second order converter arrangement with two backwards side-lobes.

The DI is comparable to that of a second order converter arrangement, with a difference of less than 3 dB. A remaining drawback is the rear side-lobes attenuated only by a 6 dB instead of 18 dB as for second order converter arrangements.

In FIG. 5 there is shown the resulting amplification characteristic $S_{res}$ and for comparison purposes the characteristic of a second order converter arrangement $S_{2nd}$ in dotted line.

In FIG. 6 there is shown the frequency roll-off according to the resulting characteristic $S_{res}$ measured in target direction, i.e. in 0° direction of FIG. 4 or 5. Therefrom, it is evident that roll-off is the same as at a first order converter arrangement, namely 20 dB per frequency decade. In dotted line there is shown the roll-off of a second order arrangement.

For the diagrams according to FIGS. 5 and 6 a spacing p of omni-directional microphones 3*a* and 3*b* of FIG. 3 was selected to be 12 mm. Thereby, the directivity index DI is constant over a frequency range up to 10 kHz.

An even higher directivity index DI with much better suppression of the back lobes can be achieved when more than two sub-arrangements are used.

In FIG. 7 and in analogy to FIG. 3 departing from two omni-directional converters as of microphones 3*a* and 3*b*, three sub-arrangements I–III are realised by means of respective signal treatment units 15', 15", 15'", e.g. defining for a "caroid"-, a "bi-directional"- and a "hyper-cardoid"-type spectral amplification characteristic as of (a) to (c) of FIG. 1. Here it becomes evident that time domain to frequency domain conversion advantageously is performed directly after the converters 3*a*, 3*b*, as then only two TFC-units 16', 16" are necessary. In such case the units 15' to 15'" are realised operating in frequency domain.

The further signal treatment is in analogy to that described in FIG. 3, i.e. relative signal amplification ($\alpha$) in at least two of the three processing units 17' to 17 '". The three outputs of the units 17' to 7'" are fed to the "comparing and passing" unit 19, which again, frequency-specifically, outputs signals $A_{19}$ according to, in a preferred mode, the minimum spectral power signal which is input from one of the inputs $E_1$ to $E_3$. Thereby, the minimal value of a cardoid-, a hyper-cardoid- and a bi-directional-type sub-arrangement is passed. Especially if in unit 19 as in unit 9 of FIG. 3, spectral "power" signals are compared, it is again proposed, as shown in dotted lines, to separate "comparing" and "passing" i.e. switching function. Then unit 19 performs spectral comparison only on power and switching unit 11 passes spectral amplitudes, controlled by spectral binary control signal at the output of unit 19 acting then as mere "comparing" unit.

The resulting directivity pattern is exemplified in FIG. 8 by $S'_{res}$, to be compared with a second order amplification characteristic $S_{2nd}$.

The resulting characteristic has zero amplification for impinging angles of 90°, of about 109°, and 180°. Thereby, a directivity index DI of 7.6 dB is achieved along all the bandwidths up to 10 kHz with a frequency roll-off, again according to a first order arrangement, namely of 20 dB per frequency decade. As may be seen from FIG. 8 when comparing with FIG. 5 the side or backwards lobe suppression is significantly larger with the further advantage of zero-amplification at 90°, at about 109° and at 180°.

A still further improvement shall be described with the help of the FIGS. 9 to 11. Thereby and as shown in FIG. 9 two converter sub-arrangements are formed with three converters, e.g. with omni-directional converters as microphones $\mathbf{3}_{a1}$, $\mathbf{3}_{a2}$ and $\mathbf{3}_b$. From the two sub-arrangements with one common converter $\mathbf{3}_b$, thus $\mathbf{3}_{a1}/\mathbf{3}_b$ and $\mathbf{3}_{a2}/\mathbf{3}_b$ and following the above mentioned "delay and superimpose"-technique e.g. with equal time delays $\tau$, there result two sub-arrangement output signals $E_1'$, $E_2'$. As shown in FIG. 11 these two "hyper-cardoid"-arrangement output signals are input to signal treatment units 27, 27" where target compensation by means of relative amplification, as of $\alpha$ of FIG. 3, occurs. Time to frequency domain conversion is performed (not shown)) between the converters $\mathbf{3}a_1$, $\mathbf{3}a_2$, 3*b* and the "compare and pass" or "comparing" unit 29. In this case it might be advantageous to provide just two TFC-units downstream the units 25', 25".

It has to be noted that the 0°-axis for both the converter arrangements of FIG. 9 are warped as by an angle $\phi$.

When further treating the resulting signals at the output of the units 27', 27" and according to FIG. 3, preferably by a minimum selecting "compare and pass" unit 29 or by a "comparing" unit at 29 and a "passing" or switching unit 11, there results an output signal with a spectral amplification characteristic as shown in FIG. 10. Again a so-called 1½-order arrangement is formed, whereby the backwards lobes may further and significantly be reduced by making use of more than two sub-arrangements.

Following up the technique as was described e.g. with the help of FIG. 7 or 9, 11, five different converter sub-arrangements were applied and their signals exploited. Minimum selection/passing and applying five first order sub-arrangements, there resulted the spatial amplification characteristic $S_{res}$ as shown in FIG. 12. FIG. 13 thereby shows the closest possible second order characteristic $S_{2nd}$ for comparison purpose.

According to the present invention at least two converter sub-arrangements are used which may be formed with the help of just two or of more than two converters.

In the preferred embodiment the distinct spatial amplification characteristics of the sub-arrangements are shaped with the help of the so-called "time-delay and superimpose" technique as was described above.

Thereby and following up this technique the space—p—between two converters concomitantly forming one of the sub-arrangements is an important parameter. In order to change this value, in a first approach obviously the microphones have to be physically moved.

In the above mentioned EP-A 0 802 699 and with its US and PCT counterparts it is taught how the effective spacing between converters, as microphones, may be virtually changed. This is accomplished principally in that the phase difference of the output signals of two converters is determined and is multiplied by a factor. One of the two output signals of the converters is phase shifted by an amount which accords to the multiplication result. This phase shifted signal and the signal of the second converter are led to a signal processing unit wherein beam-forming on these at least two signals is performed. Thereby, beam-forming or forming of spatial amplification characteristics becomes possible as if the converters were mutually spaced by more than they are physically. With respect to this teaching too the European application as well as its US and PCT counterpart shall be integrated by reference into the present description. Thus, using this electronic virtual spacing technique of the converters of the sub-arrangements as described in the present application, it becomes possible to perform zooming as well as continuous desired controlling of the resulting spatial amplification functions $S_{res}$.

The principle of the present invention may clearly also be applied departing from directional converters and/or making use of one or more than one higher order sub-arrangement (s).

FIG. 14 shows most generically a functional block/signal flow diagram of the inventive arrangement operating according to the inventive method.

The output signal of the at least two sub-arrangements I, II with differing spatial amplification characteristics are treated in frequency domain ($\tilde{S}$). First signal $\tilde{S}_1$ which are proportional to the output signals of the sub-arrangements I, II and thus may also respectively be equal therewith are fed to a comparing unit 39. As schematically represented for each spectral frequency $f_s$ the magnitude of spectral amplitudes of the two input signals $\tilde{S}_1$ are compared. There results at the output of unit 39 a spectral binary signal $A_{39}$. The output signal $A_{39}$ of unit 39 is fed to a control input of the switching unit 41. Second signals $\tilde{S}_2$ which are also proportional to the output signals of the sub-arrangements I, II and thus also may be equal thereto are input to unit 41. At each spectral frequency $f_3$ the spectral amplitude of one of the two second signals $\tilde{S}_2$ and as controlled by the control input signal $A_{39}$ is passed to output $A_{41}$. Thus, if e.g. $A_{39}$ indicates for one specific spectral frequency $f_a$ that the one of the two signals applied to unit 39 has a smaller magnitude, this control signal $A_{39}$ will switch for this specific spectral frequency $f_a$ the spectral amplitude of that second signal $\tilde{S}_2$ to output $A_{41}$ which is proportional to the same sub-arrangement output signal as the input signal to unit 39 found as having the said smaller spectral magnitude. This is represented schematically in FIG. 14 by the arrows denoting, as an example, which spectral amplitudes of which input signals $\tilde{S}_2$ are passed to the output of unit 41.

As was described above units 39 and 41 may be combined in one "compare and pass" unit. As indicated in FIG. 14 desired proportionalities may be selected between input signals to unit 39 and/or unit 41 and output signals of the sub-arrangements.

What is claimed is:

1. A method for shaping the spatial amplification characteristic of an arrangement which converts an acoustical input signal into an electrical output signal, said spatial amplification characteristic defining for amplification with which the acoustical input signal impinging on said arrangement is amplified as a function of spatial impinging angle, to result in said electrical output signal, comprising the following steps:

providing at least two sub-arrangements (I, II) having at least one converter, each of said sub-arrangements being operable to convert the acoustical signal into respective electrical output signals with different of said spatial amplification characteristics ($S_1$, $S_2$);

generating at least two first signals which are proportional to said respective electrical output signals of said sub-arrangements in frequency domain and with a number of spectral frequencies;

generating at least two second signals which are proportional to said electrical output signals of said sub-arrangements in frequency domain and with said predetermined number of said spectral frequencies;

comparing magnitudes of spectral amplitudes of said at least two first signals at equal ones of said predetermined number of said spectral frequencies to result in comparison results for each of said spectral frequencies;

controlling by said comparison results the spectral amplitude of one of said second signals at at least one of said spectral frequencies and passing same as an output signal of said arrangement.

2. The method of claim 1, wherein said comparison results are representative for indicating which of said magnitudes of said at least two first signals and at respective ones of said spectral frequencies is larger than the other.

3. The method of claim 2, further controlling by said comparison results the amplitudes of said one of said second signals to be passed which is proportional to one of said at least two first signals which has smaller magnitudes than the other of said at least two first signals at respective of said spectral frequencies.

4. The method of claim 1, further comprising the step of realising said at least two sub-arrangements (I, II) with one common set of converters, thereby realising said different amplification characteristics by different electric treatment of output signals of said converters.

5. The method of claim 1, comprising the step of relative amplifying said first signals to be equal for the acoustical input signal, wherein said acoustical input signal impinges from at least one predetermined direction.

6. The method of claim 1, further comprising the step of selecting at least one of said sub-arrangements (I, II) to be of first order and thereby one of bi-directional-, cardoid- or hyper-cardoid-type.

7. The method of claim 1, further comprising the step of providing more than two of said sub-arrangements.

8. The method of, thereby realising at least one of said at least two sub-arrangements by means of at least two acoustical input signal to electrical output signal converters and by time delaying ($\tau$) the output signal of one of said at least two converters relative to the output signal of the second of said at least two converters and superimposing said time-delayed output signal and the output signal of said second converter to generate said output signal of said sub-arrangement.

9. The method of claim 8, thereby controlling the effective spacing of said at least two converters electronically at a stationary physical spacing thereof.

10. The method of claim 1, further comprising the step of providing said at least two sub-arrangements of converters with at least one converter in common for said at least two sub-arrangements.

11. The method of claim 1, further comprising the step of providing said at least two sub-arrangements with a respective spatial amplification characteristic, having, respectively, a maximum value for one spatial direction of input signals, said one spatial direction being different for said at least two sub-arrangement.

12. An acoustical reception arrangement comprising at least two converter sub-arrangements, each of said two sub-arrangements being operable to convert an acoustical input signal into an electric output signal; a comparing unit with at least two inputs and an output, said comparing unit being operable to compare magnitudes of spectral amplitudes at spectral frequencies of a signal applied to one of its inputs with magnitudes of spectral amplitudes at respective spectral frequencies of a signal applied to the other of said at least two inputs, thereby generating a spectral comparison result signal at its output; the outputs of said sub-arrangements being operationally connected to the inputs of said comparing unit; a switching unit with at least two inputs, a control input and an output, said switching unit switching spectral amplitudes of a signal at one of said at least two inputs to its output, a spectral signal at said control input controlling which of said at least two inputs is said one input; the output of said comparing unit being operationally connected to said control input; said at least two inputs of said switching unit being operationally connected to said outputs of said sub-arrangements, the output of said switching unit being operationally connected to said output of said arrangement.

13. The arrangement of claim 12, wherein said spectral output signal of said comparing unit indicates spectrally at which of the inputs of said comparing unit said magnitude of spectral amplitude is smaller.

14. The arrangement of claim 13, wherein said control signal of said switching unit switches said one input of said at least two inputs of said switching unit to is output at which there is applied a signal which accords to a signal applied to an input of said comparing unit and which has a magnitude that is smaller at a respective frequency than the magnitude of a signal applied to the second of said at least two inputs of said comparing unit.

15. The arrangement of claim 12, further comprising at least one amplification unit interconnected between said outputs of said sub-arrangements and at least one of said comparing unit and said switching unit.

16. The arrangement of claim 12, wherein at least one of said sub-arrangements has a first order transfer characteristic of input to output signal.

17. The arrangement of claim 12, wherein at least one of said sub-arrangements has a first order transfer characteristic of input to output signal and has one of a bidirectional, a hyper-cardoid, a cardoid spatial amplification function defining amplification of an input signal to the output signal in dependency of spatial impinging angle of said input signal onto said sub-arrangement.

18. The arrangement of claim 12, further comprising more than two of said sub-arrangements.

19. The arrangement of claim 12, wherein at least one of said at least two sub-arrangements comprises a pair of converters converting acoustical input signals to electrical output signals, the output signal of at least one of said converters being operationally connected via a time delay unit to an input of an adding unit, a second input of said adding unit being operationally connected to the output of the second of said converters, the output of said adding unit forming the output of said at least one sub-arrangement.

20. The arrangement of claim 12, wherein said at least two sub-arrangements of converters have at least one converter in common.

21. The arrangement of claim 12, wherein said arrangement serves as an input stage of a hearing aid apparatus.

22. The arrangement of claim 12, wherein at least one of said sub-arrangements comprises at least one pair of converters spaced by a fixed distance and comprising an electronic control unit for changing the space of said converters effective on said spatial amplification characteristic of said at least one sub-arrangement.

* * * * *